United States Patent [19]

Sagedahl

[11] Patent Number: 4,577,862

[45] Date of Patent: Mar. 25, 1986

[54] ISOKINETIC EXERCISE APPARATUS AND METHOD

[76] Inventor: Steven M. Sagedahl, 4814 37th Ave. South, Minneapolis, Minn. 55414

[21] Appl. No.: 575,209

[22] Filed: Jan. 30, 1984

[51] Int. Cl.[4] ..... A63B 21/00

[52] U.S. Cl. ..... 272/125; 272/129; 273/26 R

[58] Field of Search ..... 272/125, 129, 132, 117, 272/140, 135, 136, 100, 110; 73/379; 273/191 R, 191 A, 26 R, 26 B, 191 B, 186 A, 186 R, 166; 128/25 R, 25 B; 434/247

[56] References Cited

U.S. PATENT DOCUMENTS

| | | | |
|---|---|---|---|
| 1,567,530 | 12/1925 | MacNaughton | 273/191 A |
| 2,134,451 | 10/1938 | Mogren | 272/117 |
| 2,496,808 | 2/1950 | Moore | 273/166 |
| 3,462,156 | 8/1969 | Gentry . | |
| 3,465,592 | 9/1969 | Perrine | 272/125 |
| 3,567,219 | 3/1971 | Foster . | |
| 3,659,846 | 5/1972 | Kanicki | 272/136 |
| 3,703,294 | 11/1972 | Fitch | 273/191 R |
| 3,738,661 | 6/1973 | Moller . | |
| 3,784,194 | 1/1974 | Perrine . | |
| 4,211,418 | 7/1980 | Oppenheimer | 273/191 R |
| 4,328,964 | 5/1982 | Walls . | |
| 4,337,050 | 6/1982 | Engalitcheff . | |
| 4,355,633 | 10/1982 | Heilbrun . | |
| 4,486,020 | 12/1984 | Kane | 273/191 R |

OTHER PUBLICATIONS

"Isolated-Joint Testing & Exercise . . . , A Handbook for Using Cybex II and the U.B.X.T. TM ", Cybex, 2100 Smithtown Avenue, Ronkonkoma, New York 11779, 1981.

*Primary Examiner*—Richard J. Apley
*Assistant Examiner*—James Prizant
*Attorney, Agent, or Firm*—Merchant, Gould, Smith, Edell, Welter & Schmidt

[57] ABSTRACT

The present invention is directed to an exercising apparatus (20) which includes a torque arm (24) for rotation on a shaft (38) which is connected to a countertorque machine (26). The exercising person moves torque arm (24) through a flexible strap (28). Strap (28) includes a loop (36) for sliding along torque arm (24). The flexibility and sliding capability of strap (28) provide for the person to do the exact movement which he would otherwise do during an athletic event. Therefore, the person may exercise good form and coordination at the threshold speed of the resistance machine (26) for the movement of a particular sport.

11 Claims, 17 Drawing Figures

FIG. 4
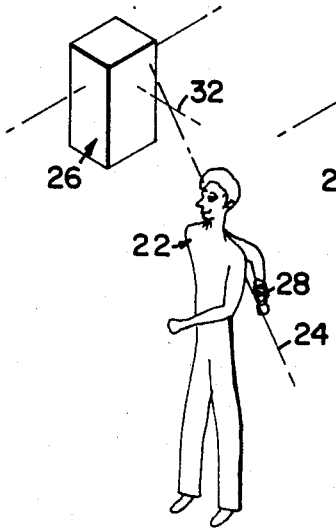
FIG. 5
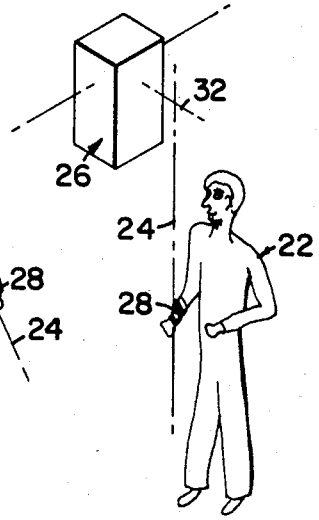
FIG. 6
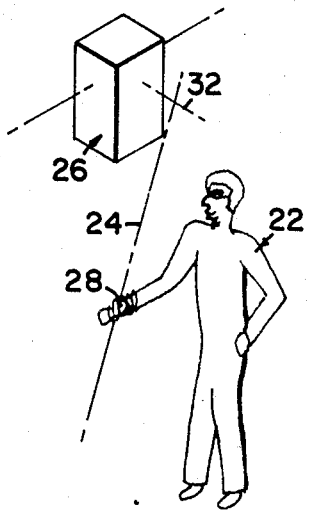
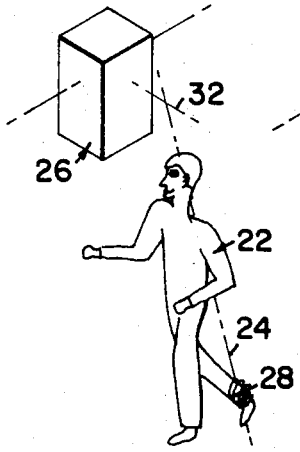
FIG. 7
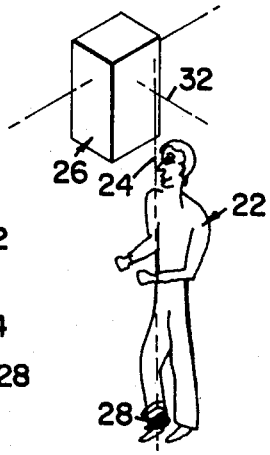
FIG. 8
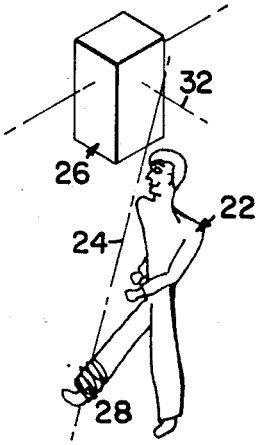
FIG. 9

FIG. 14
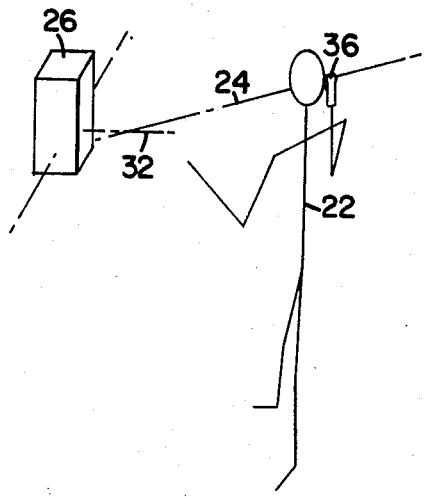
FIG. 15
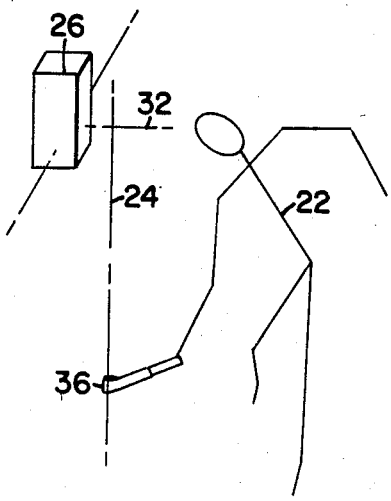
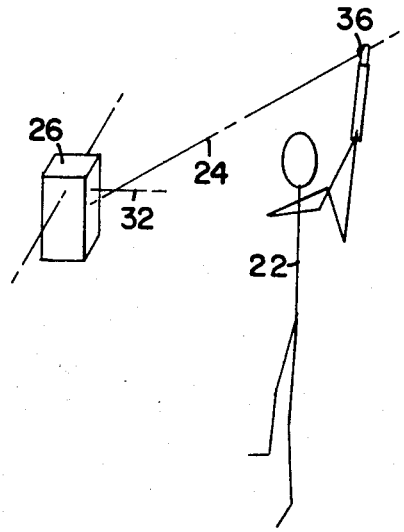
FIG. 16
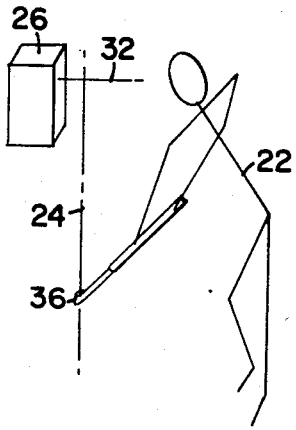
FIG. 17

ISOKINETIC EXERCISE APPARATUS AND METHOD

FIELD OF THE INVENTION

The present invention is directed to an isokinetic exercise apparatus and method and, more particularly, to an apparatus which allows a person to stress muscles while doing the specific movements applicable to a specific sport.

BACKGROUND OF THE INVENTION

Muscle exercise may be characterized as follows:

(I) Active exercise wherein the subject exerts the muscular force producing the exercise motion.

(II) Passive exercise wherein the subject does not exert the muscular force producing the exercise motion.

(A) Concentric contraction wherein the muscle shortens while the subject is contracting against external resistance.

(B) Eccentric contraction wherein the muscle lengthens while the subject is contracting against external resistance.

(1) Isotonic contraction or exercise wherein the external resistance force remains constant during a dynamic contraction, so that the speed of the exercise motion varies in response to the magnitude of the muscular force.

(2) Isometric contraction or exercise wherein the length of the muscle is held constant during a static contraction, so that the external resistance force varies in response to the magnitude of the muscular force.

(3) Isokinetic contraction or exercise wherein the speed of the exercise motion is held constant during a dynamic contraction, so that the external resistance force varies in response to the magnitude of the muscular force.

The present invention is primarily concerned with active, concentric, isokinetic exercise. However, it will be apparent that counter motions provide eccentric contraction as well.

It is well known that the overall conditioning of an athlete is very important. For this reason, many athletes lift weights, run, stretch and generally play a variety of sports to remain in good condition. Additionally, numerous practice sessions wherein the specific movements important to the athlete during his particular athletic contest are practiced over and over again many times a week. For example, in baseball a hitter may take batting practice for a period of time each day. Similarly, a football kicker will simply kick a ball many times each day. Or, a hockey player will practice numerous slaps shots day after day. Such practicing improves coordination and timing but another important aspect of the practice is the strengthening of the specific muscles which are used during the specific movement.

In a rehabilitation sense, U.S. Pat. No. 4,337,050 shows a recognition of the importance of exercising specific movements for rehabilitating a person to do the types of movements that he will do when he returns to his employment following an injury. The apparatus disclosed, however, provides only for use of various tools for rotation about a fixed axis. U.S. Pat. No. 3,567,219 shows an earlier version of similar apparatus. It provides for exercising by pushing or pulling an arm about a fixed axis.

With respect to sports, U.S. Pat. No. 2,134,451 shows the use of a baseball bat or a tennis racket attached to a weight hanging from a pulley system. Muscles are exercised to the extent that movement of the bat or racket in one direction requires a force equivalent to lifting the weight. U.S. Pat. No. 3,462,156 shows a similar idea for a golf club wherein the handle is connected with a cord to a retraction reel. U.S. Pat. No. 4,328,964 provides a more recent version of the same concept in that elastic ropes are fixed at one end and connected to various athletic instruments at the other end. Movement in one direction away from the fixed end of the ropes is resisted.

The devices of this latter group of patents provide a resisting stress for some of the muscles used during a particular athletic movement, but the design of the devices prevents the type of movement which would really be used during an athletic event and, furthermore, the devices provide resistance only in one direction while practicing any type of movement.

U.S. Pat. No. 3,738,661 discloses a golf exercising device which allows the exercising person to swing somewhat similarly to his actual golf swing. The device has an arm rotatable about an axis. The arm has a flexible portion ending in a handle. The device, however, is limited to rotating the arm about the axis and, thus, makes any swing rather circular. The flexible portion of the arm at least allows for the wrists to turn. Although many of the muscles used during a golf swing are undoubtedly exercised by this machine, the form of the swing is dictated and probably harmful of actual improvement of golfing skill.

U.S. Pat. No. 4,211,418 shows a different approach wherein an apparatus has a pair of rods at approximately 90 degrees with respect to each other. A rotational axis bisects the angle between the rods. The exercising person places a golf club in front of one rod and rotates the apparatus as the club is moved into a back swing. When the person stops, the apparatus rotates the rods 180 degrees so that the other rod makes contact with the front of the golf club. Then the person makes his foreswing while pushing the rod throughout the swing. Although the apparatus is less constraining than the device of the previously described patent, there is an artificial lag time at the top of the back swing and there would appear to be some safety problems with respect to the swinging rods, especially if the golf club were to slip off the rod or if the swinging rod made too fast an impact with the golf club as the person is at the top of his back swing.

It is clear that many exercising devices have been devised, some quite crude while others are more complex. None, however, offer the athlete the opportunity to practice in both forward and reverse directions good dynamic form while stressing the exact muscles used for a particular athletic movement.

SUMMARY OF THE INVENTION

The present invention is directed to an apparatus for isokinetically exercising by performing movements applicable to a particular sport. The apparatus comprises a torque arm and a mechanism for applying a countertorque to the torque arm. The countertorque mechanism has a rotatable shaft connected to the torque arm. The apparatus further includes a mechanism for the person to exert a force to torque the torque arm about the shaft wherein the force exerting mechanism includes a flexible element between the exercising person and the torque arm and further includes mechanism connected to the flexible element for sliding along the torque arm.

More particularly, the present invention is directed to a modification to apparatus similar to that disclosed in U.S. Pat. No. 3,465,592. Therein apparatus was disclosed for providing resistance when a shaft was rotated over a certain threshold level by an exercising person. The present invention improves the resistance apparatus by providing a flexible element which may slide along the torque arm. In this way, the person may perform an athletic movement quite freely due to the flexibility of the flexible element and the sliding capability of that element along the torque arm. Movement is hampered only by the counter resistance of the countertorque or resistance apparatus which is, of course, the purpose of the apparatus. The apparatus, therefore, stresses the exact muscles with resistance while the exercising person is doing the movement he wishes to do in the form he wishes to do it.

The present device provides for a flexible element between the torque arm and an extremity of the exercising person. One embodiment of the element includes a nylon loop for sliding along the torque arm connected by a flexible strap to a band or shoe or some other device for direct attachment or connection to the exercising person's arm or leg. In this way, the exercising person may move his upper body through the same motion as he would make while running to exercise upper body muscles used while running. By reattaching the flexible element to the foot or leg, while standing somewhat elevated on one leg, the other leg may be moved through the exact motion that the person would make while kicking or running thereby exercising the exact muscles used while doing the exact motion which would be used for performing those functions. Furthermore, the body extremity may be moved forward and backward, and resistance will be applied in both directions so as to exercise all muscles in both directions.

The present invention may also be used particularly advantageously with specific athletic instruments, such as, baseball bats, tennis rackets, handball rackets, hockey sticks, etc. That is, such instruments may be attached at the operational end to the flexible element. The exercising person then grasps the instrument by the handle in the usual way. Since the flexible element may slide along the torque arm and may twist in torsion, by appropriately orienting himself with respect to the axis of the resistance machine, the person may make the exact swing which he would otherwise make with the athletic instrument and may do so in forward and backswing directions. In each case, the various muscles of the body are exercised for the exact motion which is critical to the athlete for his particular sport.

A further advantage of the present apparatus is that the resistance of the resistance machine may be preset so that it is not applied until a predetermined angular speed is achieved. Furthermore, the apparatus includes means for adjusting the predetermined speed. Thus, a coach may watch the athlete in order to set a speed at which the athlete can maintain coordination and form. As the athlete increases in strength for the particular motion, the speed can be increased. The result of such an exercise program is clear. That is, the athlete becomes stronger and faster with good form and coordination in performing the exact critical motion needed by him for his particular sport.

These various objects and advantages of the present invention are described in more detail hereinafter with reference to a preferred embodiment as shown in the drawings briefly described as follows.

BRIEF DESCRIPTION OF THE DRAWINGS

FIGS. 4–6 illustrate schematically the motion for exercising the arm and upper body;

FIGS. 7–9 illustrate schematically the motion for exercising the leg and lower body;

FIGS. 14–15 illustrate schematically positions of a handball player at various points of a swing; and FIGS. 16–17 illustrate schematically various positions of a hockey player while taking a slap shot.

DETAILED DESCRIPTION OF THE PREFERRED AND OTHER EMBODIMENTS

Figure 1:
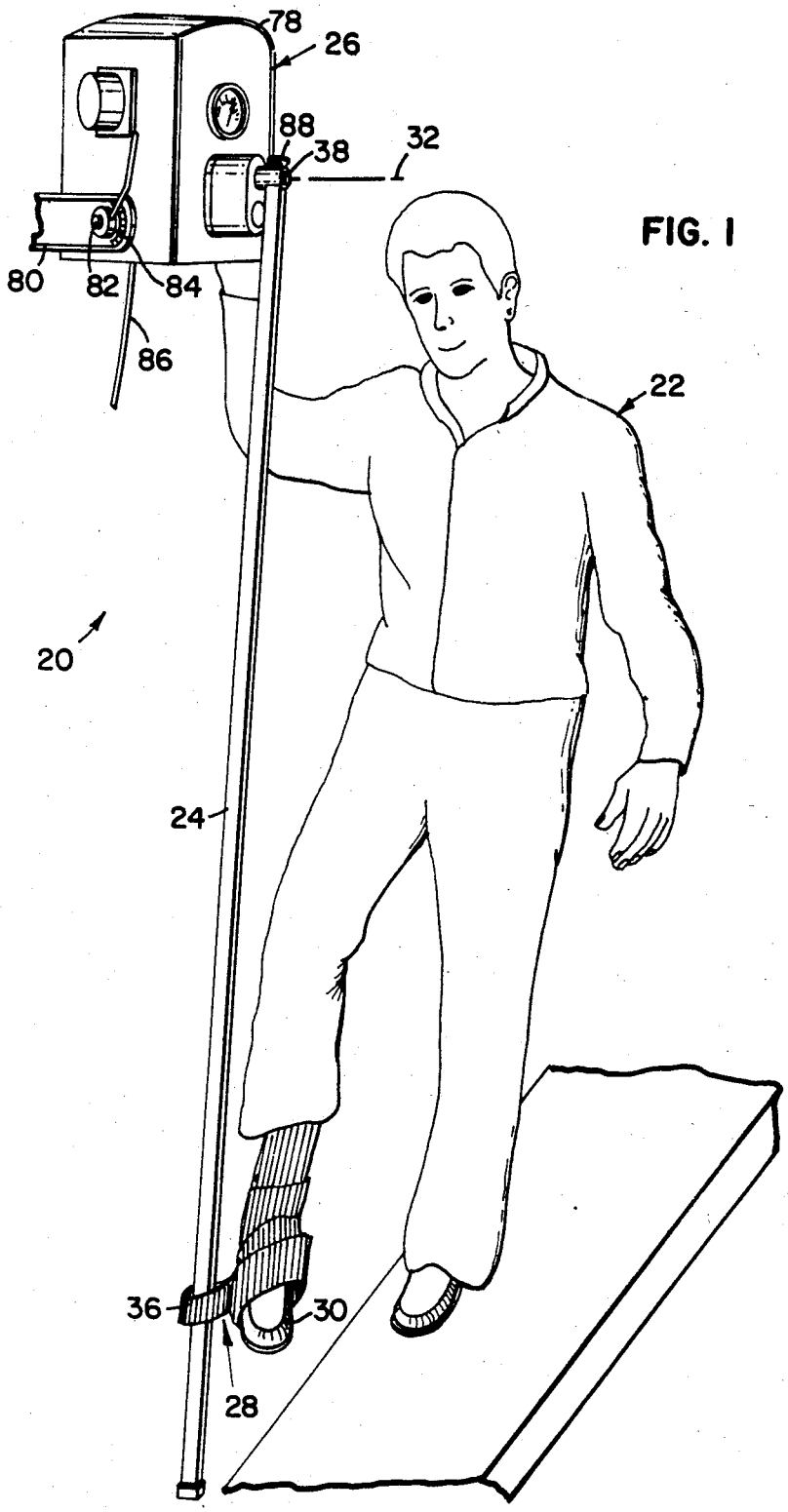
FIG. 1 is a perspective view of a person exercising with the apparatus of the present invention.

Referring now to the drawings wherein like numerals designate identical or corresponding parts throughout the several views, and more particularly to FIG. 1, apparatus in accordance with the present invention is designated generally by the numeral 20. Apparatus 20 is being used by an exercising person 22. Apparatus 20 includes a torque arm 24 connected at one end to a machine 26 capable of applying a countertorque at a predetermined angular speed. At the other end a flexible strap 28 connects the foot 30 of person 22 slidably to torque arm 24. Torque arm 24 is forced by person 22 to rotate about axis 32. Machine 26 is preset to apply a countertorque when the speed of rotation of torque arm 24 reaches a predetermined value. Strap 28 is fixed to an extremity of person 22. In FIG. 1, strap 28 is shown fixed to foot 30 while in FIG. 3, strap 28 is shown fixed to the arm 34 of person 22. Strap 28 includes a loop 36 made of material which readily slides along arm 24.

The concept of the present exercising method is that the apparatus allows person 22 to make a particular athletic move using the form and coordination near the speed at which the move would ordinarily be made while at the same time providing with machine 26 a counter resistance which stresses and thereby strengthens the muscles used in that movement. As the muscles get stronger and stronger, the predetermined rotational speed at which resistance is applied may be increased so that person 22 gains speed and strength for the movement. Thus, the method of the present invention includes presetting the countertorque machine 26 so that a resistance force is applied to rotatable shaft 38 at a predetermined rotational speed. Flexible member 28 is connected between person 22 and torque arm 24. It is understood that torque arm 24 is attached nonparallel to shaft 38 and that flexible member 28 is slidable along torque arm 24. The person then moves torque arm 24 through flexible member 28 with a force which causes rotation of shaft 38 at the predetermined rotational speed. As indicated hereinbelow, resistance may be applied by machine 26 for both clockwise and counterclockwise rotations of shaft 38 so that all muscles for the complete athletic movement are exercised.

Resistance machine 26 may be of a type described in U.S. Pat. No. 3,465,592. Representative of such machines is the apparatus schematically illustrated in FIG. 2. Worm 40 is rotated by an electric motor 42 at a constant rotational velocity in the clockwise direction. A worm gear 44 is meshed with and driven counterclockwise by the worm 40 and is fixed to the upper element of an overrunning clutch 46. The worm 40 has a pitch such that the worm 40 can rotate worm gear 44, but worm gear 44 cannot rotate worm 40. Clutch 46 transmits torque from its outer element to its inner element in one direction only, and then only when the inner element is already being rotated in that direction at the same velocity that the outer element is rotating. Such a clutch 46 is conventional. The inner element of clutch 46 is fixed to a shaft 48 which is fixed to a gear 50.

A worm gear 52 is meshed with and driven clockwise by worm 40, and is fixed to the outer element of an overrunning clutch 54. Clutch 54 is similar to clutch 46. The inner element of clutch 54 is fixed to shaft 56 which is fixed to gear 58. Gears 50 and 58 are each meshed with a third gear 60 which is fixed to shaft 38. Shaft 38 is driven by torque arm 24 as discussed hereinbefore and may be driven either clockwise or counterclockwise by the person exercising. In that regard, clutch 46 transmits torque only in the counterclockwise direction, while clutch 54 transmits torque only in the clockwise direction.

When the person exercising rotates shaft 38 below a threshold speed, neither of clutches 46 nor 54 engages to transmit torque, and the worm 40 is rotated by motor 42 without loading. When the person exercising rotates shaft 38 clockwise, shaft 48 is rotated counterclockwise and if done so at the threshold speed, clutch 46 engages to couple worm 40 through worm gear 44, clutch 46, shaft 48, gear 50 and gear 60 to shaft 38. Regardless of how much torque the person exercising applies to shaft 38, worm 40 will rotate at a constant speed thereby resisting, in effect, an aiding load. Similarly, when the person exercising rotates shaft 38 counterclockwise, shaft 56 is rotated and if it is rotated at the threshold speed, clutch 54 engages to couple worm 40 through worm gear 52, clutch 54, shaft 56, gear 58 and gear 60 to shaft 38.

Machine 26, once a clutch 46 or 54 has been engaged, is not capable of being accelerated by the person exercising, due to the unidirectional characteristic of motor 42 and the worm drive system. Any applied force tending to increase the torque to increase the threshold speed over which a clutch is engaged is opposed by a reaction force or countertorque from the gear system causing the system to yield relatively slowly against the applied overforce. When the applied force decreases below the threshold of clutch engagement, countertorque or resistance is no longer applied. Thus, machine 26 applies a kinetic resistance to the action of the person exercising, which is delicately responsive to the force which that person applies and is always slightly less than the force which he applies, from instant to instant.

Motor 42 is energized by an energy source 62. A switch 64 in series with motor 42 provides the possibility of an "isometric hold". A speed control or mechanism for adjusting the threshold speed at which countertorque is applied comprises an auto transformer or a potentiometer and a silicon control rectifier all of which are conventional and are represented by numeral 66. The adjusting mechanism may set threshold speeds in excess of 300 angular degrees per second.

A further feature which may be incorporated into the system includes a pair of magnetic clutches 68 and 70 interposed in series with shafts 48 and 56, respectively. The maximum torque which can be transmitted by clutch 68 is adjustably controlled by a rheostat 72 in series with clutch 68 and a source 74. The maximum torque which can be transmitted by clutch 70 is adjustably controlled by a rheostat 76 which is in series with clutch 70 and also with the source 74. These clutches 68 and 70 begin to slip at a given torque, and any force over such torque applied by the person exercising is dissipated in acceleration. Thus, clutches 68 and 70 may be used to provide some slight resistance to the rotation of shaft 38 as the rotational speed of shaft 38 increases to the threshold speed of clutch 46 or clutch 52.

Figure 2:
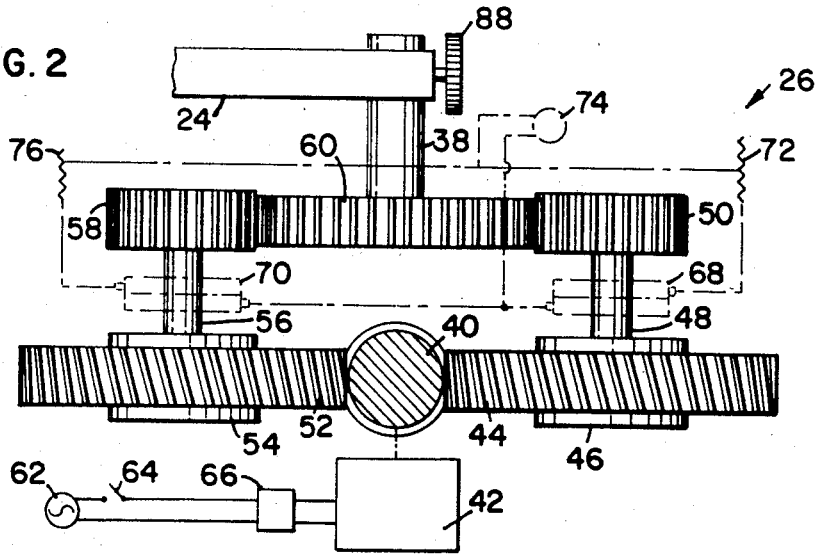
FIG. 2 is a schematic diagram of a prior art resistance device representative of the type which could be used in accordance with the present invention.

As shown in FIG. 1, apparatus like that described with respect to FIG. 2 is contained in housing 78. Housing 78 is held by a pair of arms 80 to a fixed framework (not shown). Housing 78 may be pivoted with respect to arms 80 at shaft 82 by loosening a threaded knob 84. Wiring cables 86 extend to control electronics 66 of the type described hereinbefore. Torque arm 24 is held fixed to shaft 38 with a set screw 88 having a knob, for example, thereon.

Figure 3:
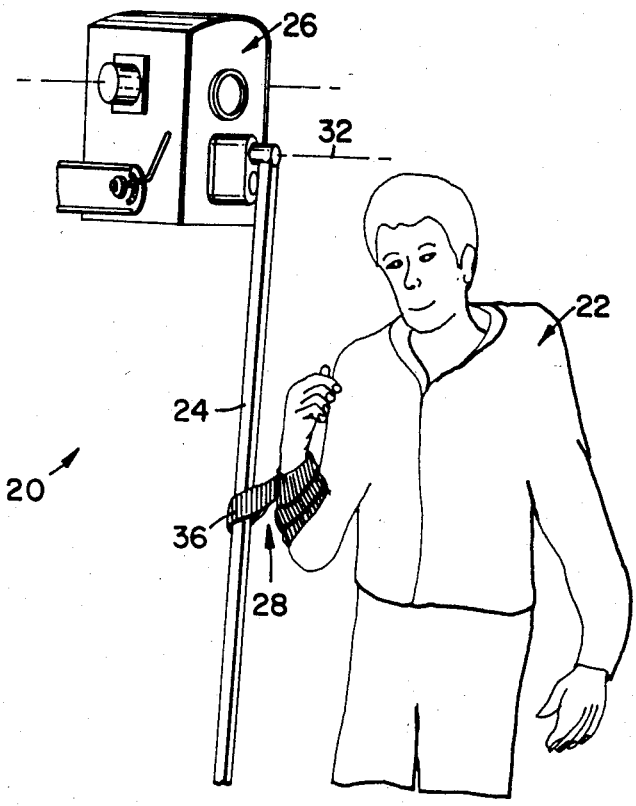
FIG. 3 is a perspective view similar to FIG. 1 showing the person exercising a different extremity.

Strap 28 provides the all-important connection between an extremity of exercising person 22 and torque arm 24. Strap 28 must be flexible so that it may be twisted or moved in rotation about a pair of axes orthogonal to the torque arm. In addition, strap 28 must include a loop 36 which is slidable along torque arm 24. Thus, strap 28 provides complete movement freedom except for perpendicular translation away from torque arm 24. Strap 28 is sufficiently long that it may be wrapped about the foot or leg, for example, of person 22 and taped in place. Alternatively, strap 22 may include an elastic loop for slipping onto the arm of person 22 as shown in FIG. 3. Other embodiments are also envisioned, for example, to include direct connection of strap 28 to a shoe or to a glove.

FIGS. 4–6 illustrate the type of movement made by a runner with his upper body. A runner needs good strength not only in the legs, but also throughout his body and particularly his upper body. FIG. 4 shows an exercising runner with his arm behind him; FIG. 5 shows the arm approximately even with his body; and FIG. 6 shows the arm in front of the exercising person. Reverse movement is similar going from FIG. 6 to FIG. 5 to FIG. 4. In all cases, the flexible strap allows various rotational positions with respect to torque arm 24 while loop 36 of strap 28 provides for sliding along torque arm 24. It is understood that the left arm may be exercised in a similar fashion.

FIGS. 7–9 provide a similar illustration of movements for exercising the leg, for example, for running or kicking or even perhaps swimming or other such sports.

Figure 10:
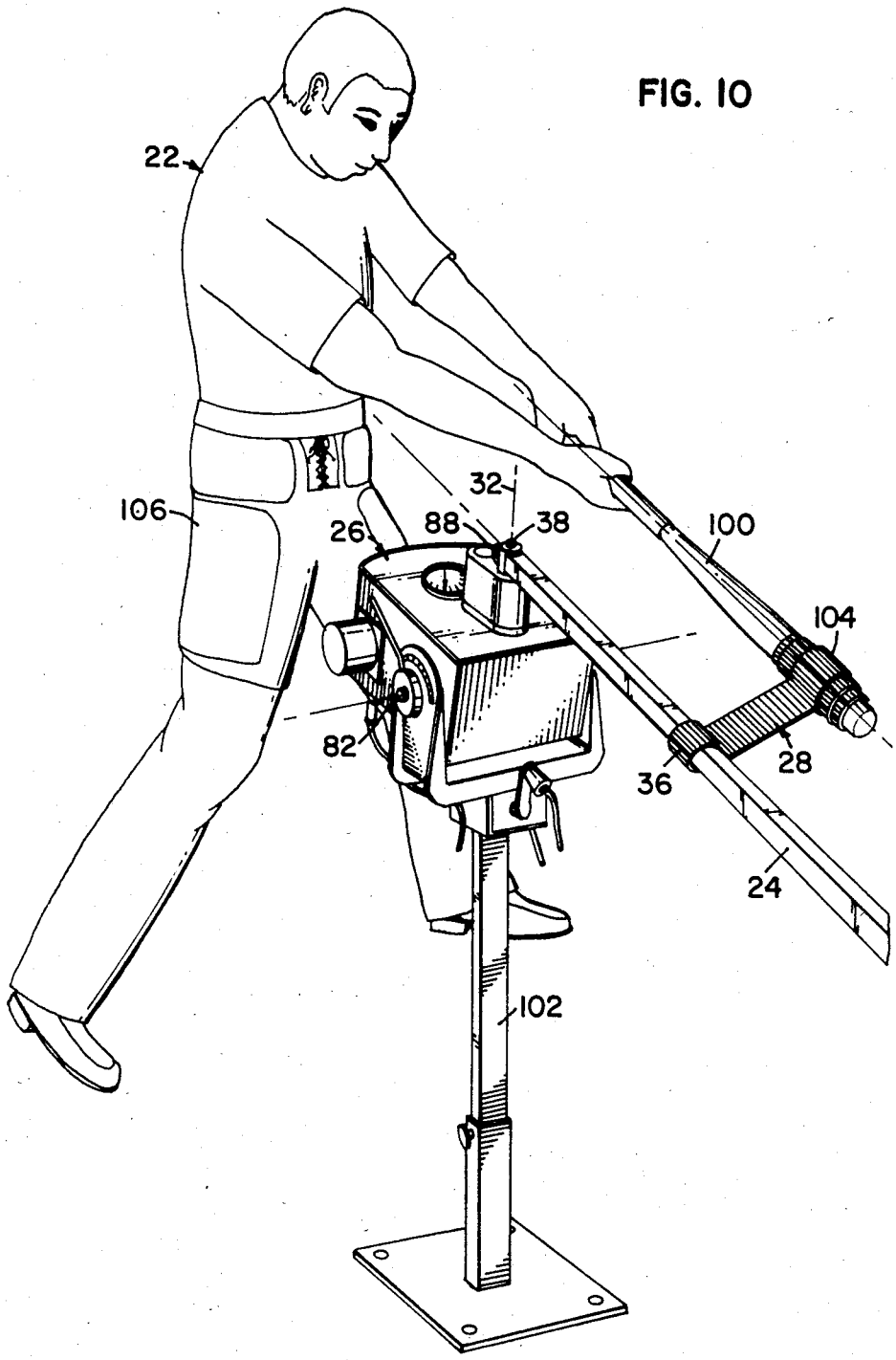
FIG. 10 is a perspective view of a baseball player exercising with a bat and the other apparatus in accordance with the present invention.
Figure 11:
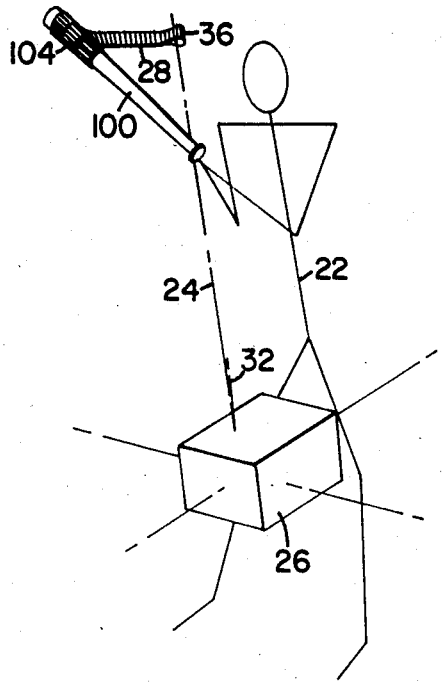
FIGS. 11–13 illustrate schematically positions of a batter at various points in a swing.
Figure 12:
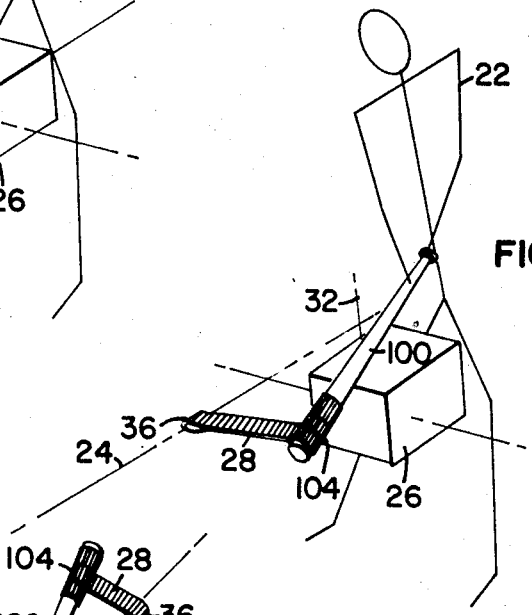
Figure 13:
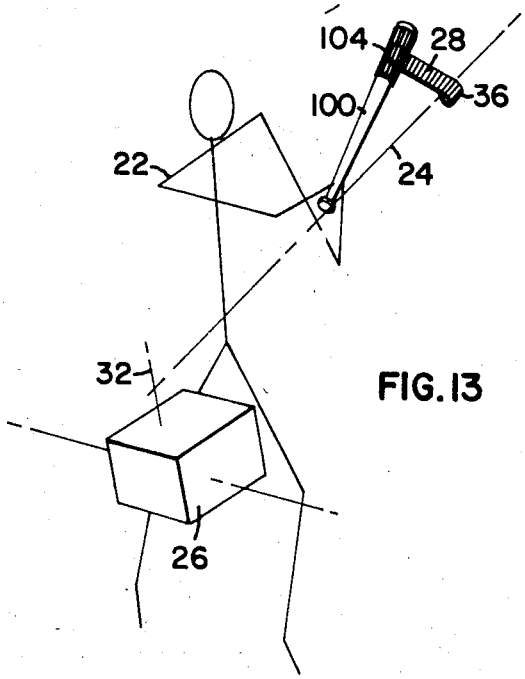

The concept of allowing strap 28 to slid along torque arm 24 so that an athlete may exercise an important movement at a speed where he can maintain form and coordination is a distinct breakthrough for athletic training. The concept takes on even more significance when it is understood that strap 28 may be attached to an athletic instrument such as baseball bat 100 shown in FIG. 10. That is, apparatus 20 may be used not only for direct connection to an extremity of an exercising person but may be used in conjunction with performing the movements and exercising the muscles for sports wherein an athletic instrument, but as, a baseball bat, a tennis racket, a handball racket, a hockey stick, etc., is used. As shown in FIG. 10, machine 26 is mounted on a stand 102 fixed to the floor. Machine 26 is placed at an appropriate height and oriented at shaft 82 so that shaft 38 and axis 32 are substantially vertical. Torque arm 24 then extends away from machine 26 at an orientation substantially horizontal with respect to the floor. Strap 28 includes loop 36 of a material, such as nylon, which easily slides along torque arm 24. The other end of strap 28 is fastened with, for example, tape 104 to the end of bat 100. The batter or exercising person 22 stands on the side of machine 26 opposite torque arm 24. It is preferable for person 22 to wear some protection, such as hockey girdle 106, in the area of his hips so that torque arm 22 does not injure him as he swings from a complete backswing to a complete follow through. That is, the person may hold the bat by the handle in the usual fashion and pull the torque arm clockwise, for a right handed batter, to get in a position to swing (see also FIG. 11). As the person starts swinging counterclockwise the torque arm is accelerated in rotation until at the midrange of his swing (see FIGS. 10 and 12) the greatest speed and torque is applied, wherein the predetermined speed of machine 26 is reached and a counter-torque resistance is applied. Through the midrange, the person must work his muscles quite hard to try to maintain and increase the speed of his swing. As he goes into the follow through (see FIG. 13) the rotational speed decreases, likely below the threshold speed of machine 26, so that torque arm 24 may come around to strike the protection of girdlle 106. Person 22 can then reverse the swing, for example in the sequence from FIG. 13 to FIG. 12 to FIG. 11 so as to exercise the appropriate muscles in both directions.

Similar use of apparatus 20 in conjunction with other athletic instruments is shown in FIGS. 14–17. In FIGS. 14–15, a movement common with a racket grasped with one hand, such as a handball racket, is illustrated. In FIGS. 16–17 a movement of a type used with an instrument, such as a hockey stick, wherein the instrument is grasped with two hands is shown. In each of these latter two cases, the axis of rotation of machine 26 is substantially horizontal, as opposed to the substantially vertical orientation with respect to a baseball hitter as shown in FIG. 10.

Thus, the apparatus of the invention may not only be used in direct connection with the person, but may be used by a person to exercise movements with athletic instruments which are applicable to the particular sports in which such instruments are used. The method of exercise includes presetting the countertorque resisting machine 26 for initiating the resistance force at a predetermined rotational speed. Flexible member 28 is then connected between a portion of the athletic instrument, such as bat 100, and torque arm 24. The torque arm as hereinbefore indicated is attached nonparallel to axis 32 of shaft 38. The flexible member 28 is slidable along torque arm 24. Finally, the method includes the person drafting a handle of the athletic instrument 100 and swinging the instrument so as to move torque arm 24 with flexible member 28 with a force which causes rotation of shaft 38 at the predetermined speed thereby causing initiation of the resisting countertorque.

Even though the advantages and details of structure and function of the present exercising machine and method have been set forth in detail, they must be considered exemplary. It is understood, therefore, that changes made, especially in matters of shape, size, arrangement and combinations of components and assemblies, to the full extent extended by the general meaning of the terms in which the appended claims are expressed, are within the principle of the invention.

What is claimed is:

1. An exercise apparatus for a person, comprising:
a shaft rotatable about a first axis;
means for resisting the rotation of said shaft;
a torque arm;
first means for connecting said torque arm to said shaft such that said torque arm is nonparallel to said first axis;
means for unrestrainably sliding on said torque arm;
second means for connecting said sliding means to said person, said second connecting means including means for moving in rotation; and
means for attaching said second connecting means to an extremity of said person.

2. An apparatus in accordance with claim 1 wherein said sliding means includes a nylon loop.

3. An apparatus in accordance with claim 2 wherein said attaching means includes an elastic band.

4. An apparatus in accordance with claim 3 wherein said rotation moving means includes a flexible strap having at opposite ends said nylon loop and said elastic band.

5. An exercise apparatus for a person, comprising:
a rotational shaft;
a housing for supporting said shaft, said housing containing means for initiating counter-torque to the rotational speed of said shaft to limit the speed to approximately a predetermined value;
a torque arm;
first means for connecting said torque arm to said shaft so that said torque arm is non-parallel to said shaft; and
a flexible member having a loop at one end for unrestrainably sliding along said torque arm and means for attaching to an extremity of a person at a second end.

6. A method of exercising for a person comprising the steps of:
presetting a counter-torque resisting means for a rotatable shaft for initiating a resistance force at a predetermined rotational speed;
connecting a flexible member between said person and a torque arm, said torque arm being attached non-parallel to said shaft, said flexible member being unrestrainably slideable on said torque arm;
said person moving said torque arm through said flexible member with a force which causes unrestrainable sliding along said torque arm and rotation of said shaft at the predetermined speed.

7. An apparatus for isokinetically exercising with movements applicable to a particular sport, said apparatus comprising:
a torque arm;
means for applying a counter-torque to said torque arm, said counter-torque means having a rotatable shaft connected to said torque arm; and
means for a person to exert a force to torque said arm about said shaft, said force exerting means including a flexible element between said person and said arm and further including means connected to said flexible element for unrestrainably sliding on said arm.

8. An apparatus in accordance with claim 7 wherein said sliding means includes a nylon loop attached to said flexible element.

9. An apparatus in accordance with claim 7 wherein said force exerting means includes a handle for an athletic instrument, said handle being connected to said flexible element, said handle for grasping by said person.

10. An apparatus for isokinetically exercising muscles used while hitting a baseball, said apparatus comprising:

a rotatable shaft;

an arm for applying a torque to said shaft;

means for attaching said torque arm to said shaft so that said arm is non-parallel to said shaft;

means for applying at a predetermined angular speed a counter torque to said shaft;

means for adjusting the angular speed at which said applying means applies counter torque;

a baseball bat for an exercising person to swing;

a flexible member;

means for connecting said flexible member to said torque arm, said connecting means including means for unrestrainably sliding along said torque arm; and means for fastening said flexible member to said baseball bat.

11. A method for a person to exercise movements applicable to a particular sport, said method comprising the steps of:

presetting a counter-torque resisting means for a rotatable shaft for initiating a resistance force at a predetermined rotational speed;

connecting a flexible member between a portion of an athletic instrument and a torque arm, said torque arm being attached non-parallel to said shaft, said flexible member being unrestrainably slideable on said torque arm;

said person grasping a handle of said athletic instrument and swinging said instrument so as to move said torque arm through said flexible member with a force which causes sliding along said torque arm and rotation of said shaft at the predetermined speed.

* * * * *